US006729663B2

(12) United States Patent
Fisher

(10) Patent No.: US 6,729,663 B2
(45) Date of Patent: May 4, 2004

(54) LOCK ASSEMBLY WITH SUPERLOCKING MECHANISM

(75) Inventor: Sidney Edward Fisher, Shirley (GB)

(73) Assignee: Meritor Light Vehicle Systems (UK) Limited (GB)

( * ) Notice: Subject to any disclaimer, the term of this patent is extended or adjusted under 35 U.S.C. 154(b) by 0 days.

(21) Appl. No.: 09/841,419

(22) Filed: Apr. 24, 2001

(65) Prior Publication Data

US 2002/0043084 A1 Apr. 18, 2002

(30) Foreign Application Priority Data

Apr. 25, 2000 (GB) ..... 0009793

(51) Int. Cl.[7] ..... E05C 3/06
(52) U.S. Cl. ..... 292/201; 292/216; 292/DIG. 23
(58) Field of Search ..... 292/216, 201, 292/DIG. 62, DIG. 61, DIG. 23

(56) References Cited

U.S. PATENT DOCUMENTS

| | | | | | |
|---|---|---|---|---|---|
| 4,364,249 | A | * | 12/1982 | Kleefeldt | 292/144 |
| 4,986,098 | A | * | 1/1991 | Fisher | 70/262 |
| 5,439,261 | A | * | 8/1995 | O'Hare | 292/201 |
| 5,577,782 | A | * | 11/1996 | Johnson et al. | 292/216 |
| 5,615,564 | A | * | 4/1997 | Inoue | 292/144 |
| 5,656,899 | A | * | 8/1997 | Kuroda | 292/201 |
| 5,718,135 | A | * | 2/1998 | Bertenshaw et al. | 292/44 |
| 5,762,384 | A | * | 6/1998 | Bartel | 292/201 |
| 5,765,884 | A | | 6/1998 | Armbruster | |
| 5,769,468 | A | * | 6/1998 | Armbruster | 292/201 |
| 5,899,508 | A | * | 5/1999 | Cetnar et al. | 292/216 |

FOREIGN PATENT DOCUMENTS

| | | |
|---|---|---|
| DE | 4130094 | 9/1992 |
| DE | 9414181 | 2/1995 |
| DE | 19650928 | 6/1998 |
| EP | 0302642 | 2/1989 |
| GB | 2 278 394 A | 11/1994 |
| GB | 2 285 476 A | 7/1995 |
| WO | WO99/57397 | 11/1999 |
| WO | WO00/05469 | 2/2000 |

OTHER PUBLICATIONS

Search Report under Section 17, Oct. 24, 2000.

* cited by examiner

*Primary Examiner*—Robert J. Sandy
*Assistant Examiner*—Thomas Ho
(74) *Attorney, Agent, or Firm*—Carlson, Gaskey & Olds

(57) ABSTRACT

A lock mechanism (10, 110) including a lock gear lever (12, 112) movable between unlocked, locked and superlocked positions, the lock lever being connected to further components of the lock mechanism to provide for corresponding unlocked, locked and superlocked conditions of the lock mechanism, the lock lever being operably movable between the unlocked, locked and superlocked positions by a stepper motor (22, 122) (FIG. 7).

13 Claims, 2 Drawing Sheets

UNLOCKED

LOCKED

SUPERLOCKED

SUPERLOCKED

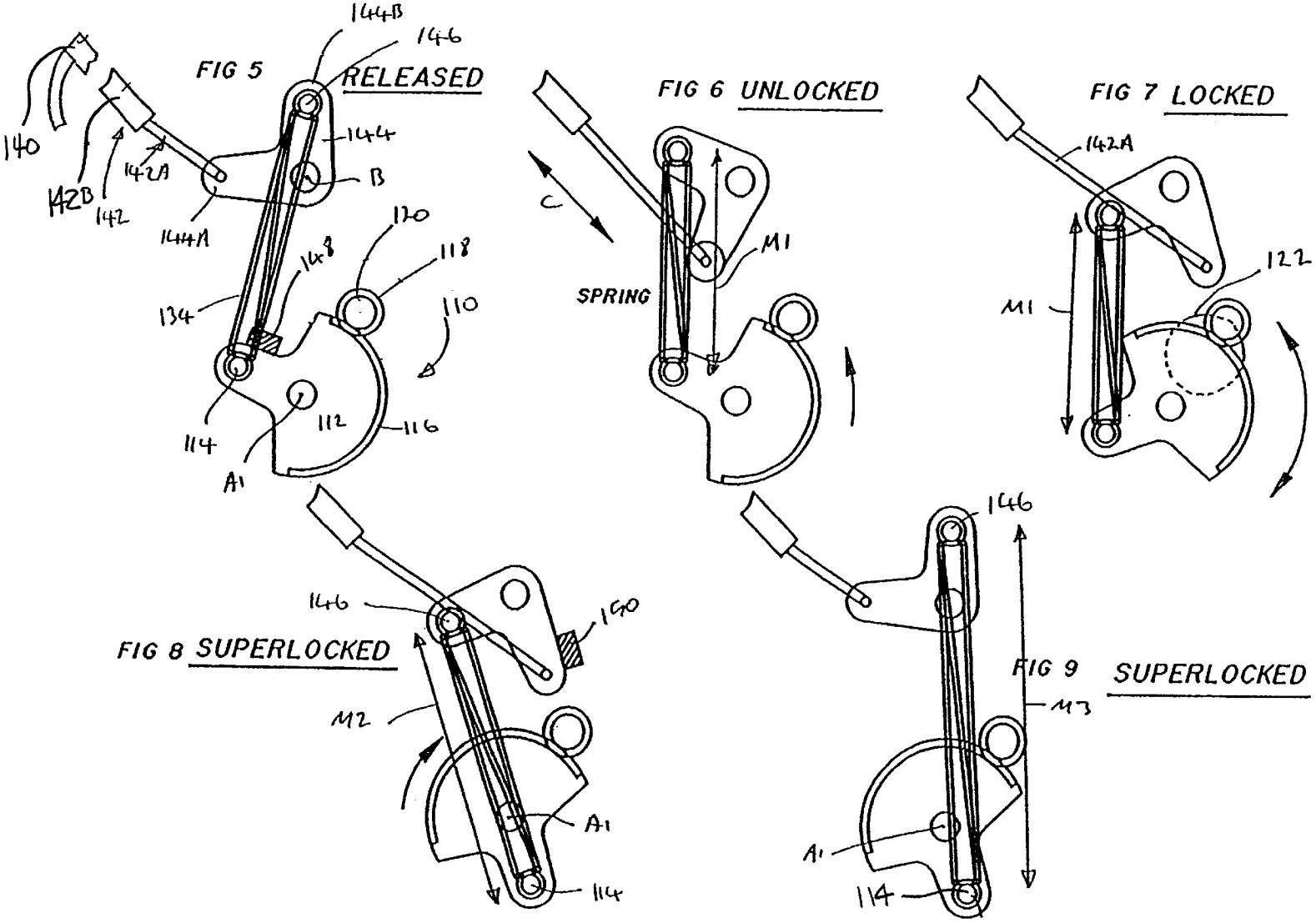
FIG 7 LOCKED
FIG 6 UNLOCKED
FIG 9 SUPERLOCKED
FIG 5 RELEASED
FIG 8 SUPERLOCKED
SPRING
M1
M2
M3
A1
B
C
110
112
114
116
118
120
122
134
140
142
142A
142B
144
144A
144B
146
150

LOCK ASSEMBLY WITH SUPERLOCKING MECHANISM

This application claims priority to United Kingdom patent application number 0009793.1 filed on Apr. 25, 2000.

BACKGROUND OF THE INVENTION

The present invention relates to lock mechanisms and in particular lockable latch mechanisms for use with motor vehicles.

Known vehicle door latch mechanisms include a locking feature, whereby the latch can be locked, thereby preventing opening of an associated door from the outside (but allowing opening of the door from the inside) or the latch can be unlocked, thereby allowing opening of the associated door from the both inside or the outside.

Known latch mechanisms also incorporate superlocking (also known as deadlocking) features whereby in the event that an unauthorized person gains access to the inside of a vehicle, that person is nevertheless prevented from opening the door from the inside.

Previously, motor driven central locking systems have been operated by providing a pulse of energy to a motor which rotates a locking gear between an unlocked and locked position. The locking gear is prevented from turning to the superlocked position by a solenoid actuated pin arrangement in a track or recess cut from the lock gear. In order to superlock the door, a superlock command is passed to the lock system and the solenoid withdraws the pin from the track. A pulse of energy is then applied to the motor to drive the locking gear. As the locking gear is not restricted in its travel by the pin, it can move to a superlock state. However, such an arrangement requires two actuators namely the drive motor and the solenoid and further requires and appropriate control arrangement to ensure synchronization between the motor and solenoid.

SUMMARY OF THE INVENTION

It is an object of the present invention to provide an improved vehicle lock mechanism.

Thus according to the present invention there is provided a lock mechanism including a lock lever movable between unlocked, locked and superlocked positions, the lock lever being connected to further components of the lock mechanism to provide for corresponding unlocked, locked and superlocked conditions of the lock mechanism, the lock lever being operably movable between the unlocked, locked and superlocked positions by a stepper motor.

In that way, one drive effects stepped motion between the three lock lever positions without the need for a solenoid actuation pin.

BRIEF DESCRIPTION OF THE DRAWINGS

The invention will now be described, by way of example only, with reference to the accompanying drawings in which:

FIG. 5 is a schematic cross-sectional view of a second embodiment of a lock mechanism according to the present invention shown in a released condition;

FIGS. 6 to 8 show the lock mechanism of FIG. 5 in an unlocked, locked and superlocked position;

FIG. 9 is a view similar to FIG. 8 with the lock mechanism in a superlocked position but with release element in a released position.

DETAILED DESCRIPTION OF THE PREFERRED EMBODIMENT

Figure 1:
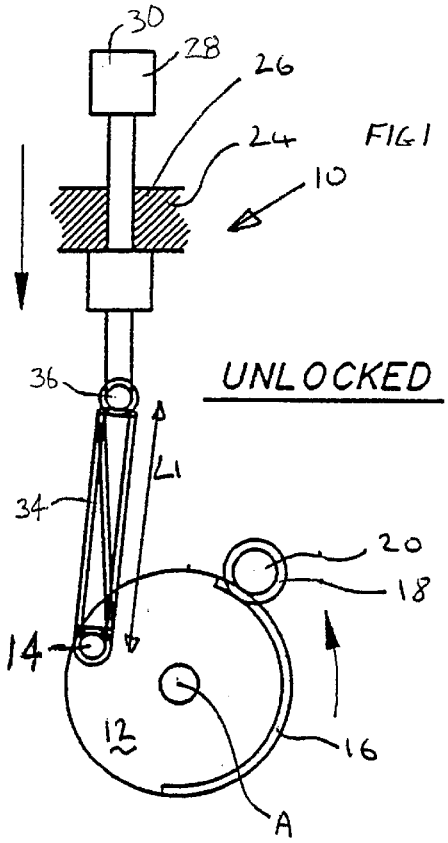
FIGS. 1 to 3 are schematic views of a lock mechanism shown in an unlocked, locked and superlocked condition.

With reference to FIGS. 1 to 4 there is shown schematically, elements of a lock mechanism (10) according to the present invention. The lock mechanism includes a lock lever in the form of a lock gear 12 rotatably about an axis A. Lock gear 12 includes a drive pin 14 mounted on an outer edge of the lock gear and an array of drive teeth 16 (shown schematically) drive teeth 16 engage with drive teeth 18 of pinion 20 which is driven by stepper motor 22 situated behind lock gear 12 and only shown in FIG. 2 for clarity. The lock mechanism is mounted in door 24 (only part of which is shown) and includes further components to provide for a latching function.

Projecting through a sill 26 of door 24 is a manually actuatable element in the form of sill button 28.

Sill button 28 includes a holding portion 30 adapted to be grasped between the thumbed forefinger of a person actuating the sill button, and a lower pin 32 positioned within the door.

Mounted between drive pin 14 and lower pin 32 is a resilient member in the form of a tension spring 34.

Figure 2:
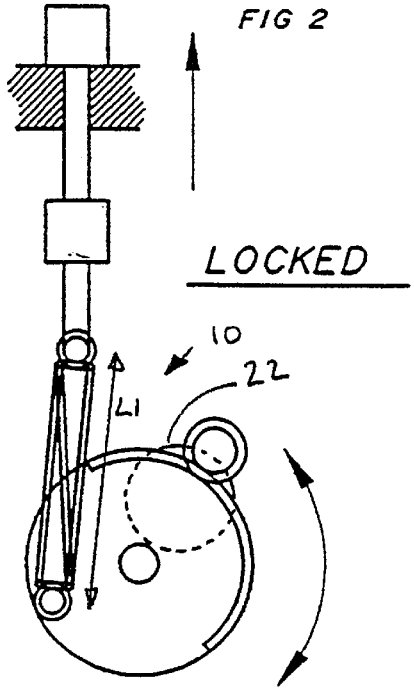
Figure 3:
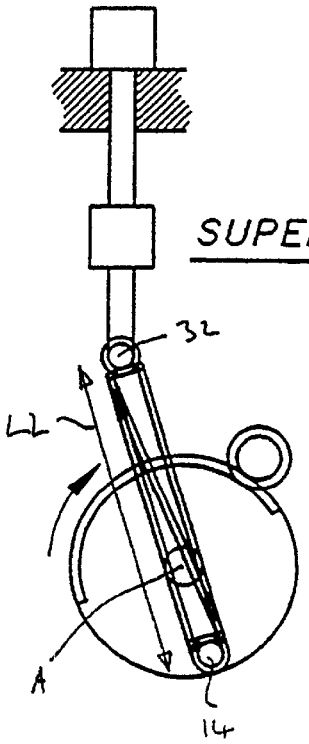
Figure 4:
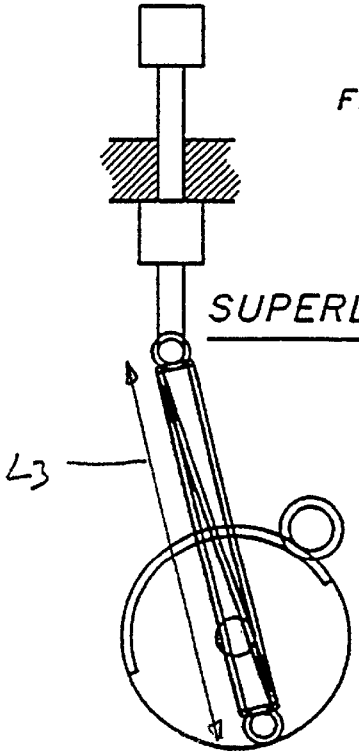
FIG. 4 is a view similar to FIG. 3 with a sill button in a lifted position.

The sill button 28 is movable between a raised position as shown in FIGS. 1 and 4 and a lower position as shown in FIGS. 2 and 3.

The locked gear is moveable between an unlocked position as shown in FIG. 1, a locked position as shown in FIG. 2 and a superlocked position as shown in FIGS. 3 and 4. The lock gear is connected to further components of the lock mechanism to provide unlocked, locked and superlocked conditions of the lock mechanism.

The stepper motor 22 is capable of driving the lock gear between it unlocked, locked and superlocked positions. This is possible since stepper motors can be driven through known angles and thus the lock gear can also be moved through a known angle depending upon the gear ratio between the motor shaft and the lock gear 12.

Operation of the lock mechanism is as follows.

From an initial starting point as shown in FIG. 1 wherein the lock mechanism is in an unlocked condition, the lock mechanism can be moved to a locked condition as shown in figure by actuation of the stepper motor 22 causing the pinion 20 to rotate clockwise through a specified angle resulting in the lock gear rotating anticlockwise through a smaller specified angle (dependent upon the gear ratio).

Alternatively the lock mechanism can be moved from the position as shown in FIG. 1 to the position as shown in FIG. 2 by depressing the sill button 28. Under these circumstances the tension spring 34 (which in an unloaded state is pre-tensioned to be in a coil bound condition) acts in compression as a solid link of length L1 and drives drive pin 14, and hence lock gear 12 anticlockwise.

Lifting of the sill button causes the tension spring 34 to act in tension resulting in the lock mechanism returning to the position as shown in FIG. 1. It should be noted that tension spring 34 has been manufactured in a pretensioned condition to be coil bound. The tensile load applied to spring 34 by the lifting of the sill button is less than the in-built pretension in the spring, thus the spring again acts, this time in tension, as a solid links of L1 as the lock mechanism is returned to the position as shown in FIG. 1.

Alternatively, driving of the stepper motor in an anticlockwise direction results in the lock mechanism returning to the position as shown in FIG. 1.

Lifting of the sill button or driving of the stepper motor anticlockwise results in the lock mechanism returning to the position as shown in FIG. 1.

It is only possible to superlock the lock mechanism by operating the stepper motor to drive the lock gear 12 to the position as shown in FIG. 3, extending tension spring 34 to length L2. It will be noted from FIG. 3 that lower pin 32, axis A and drive pin 14 are substantially in line. Thus when an attempt is made to unsuperlock the lock mechanism by lifting the sill button, substantially no torque is applied to the lock gear and as such it does not rotate. Thus the lock gear remains in its superlocked position.

It can be seen from FIG. 4 that lifting of the sill button merely extends the tension spring 34 to length L3.

With reference to FIGS. 5 to 9 there is shown a second embodiment of a lock mechanism 110 according to the present invention wherein element performing the function as those elements in lock mechanism 10 are numbered 100 greater.

In this case the manually operable element is an inside door handle 140 connected by a push/pull cable 142 to an arm 144*a* of a release lever 144. Push/pull cable 142 include a cable inner 142*a* which can slide relative to a cable sheath 142*b*. In this case cable inner 142*a* is sufficiently rigid to act in compression without buckling in this particular installation.

The release lever is pivotally mounted about pivot axis B which is fixed relative to the lock mechanism. A second arm 144*b* includes pin 146.

The spring 134 is mounted between 146 and drive 114.

The lock mechanism 110 further includes a lock gear stop 148 and a drive path stop 150, the purpose of which will be described below.

The inside door handle 140 (along with push/pull cable 142 and crank lever 144) have a released position as shown in FIG. 5, and FIG. 9, an unlocked (or neutral) position as shown in FIG. 6 and a locked position as shown in FIGS. 7 and 8. Movement of the inside door handle between these three positions causes the push/pull cable inner to reciprocate in the direction of arrow C resulting in pivoting of the release lever 144 about axis B.

FIGS. 6, 7, 8 and 9 correspond to FIGS. 1, 2, 3 and 4 respectively with distances M1, M2 and M3 corresponding to distances L1, L2 and L3.

Movement between the positions as shown in FIGS. 6 and 7 can be achieved by manual operation of the inside door handle 140 or operation of the stepper motor 122. Movement of the lock gear to the position as shown in FIGS. 8 and 9 can only be achieved by operation of the stepper motor 122. It can be seen from FIGS. 8 and 9 that drive pin 114, axis Al of lock gear 112 and pin 146 are substantially in line when the lock mechanism 110 is in a superlocked condition.

Consideration of FIG. 5 shows that the release lever can be moved to a released position whilst the lock gear 12 remains in its unlocked position, abutting the lock gear stop 148. This relative movement is achieved by spring 134 extending. Release lever 144 is connected to further components of the lock mechanism that provides for latching and unlatching of a latch mechanism and these further components allow the latch mechanism to move to a released condition when the lock mechanism is in an unlocked condition.

It will be noted from FIG. 9 that the release lever can also move to a released position even when the lock mechanism is in a superlocked condition. However, the lock gear 12 has positioned further components of the lock mechanism such that movement of the release lever to its released position does not cause unlatching of the latch.

What is claimed is:

1. A lock mechanism including a lock lever movable between unlocked, locked and superlocked positions, the lock lever being connected to further components of the lock mechanism to provide for corresponding unlocked, locked and superlocked conditions of the lock mechanism, the lock lever being operably movable between the unlocked, locked, and superlocked positions by a stepper motor and through a drive path by a manually actuatable element, the lock mechanism further including a latch mechanism in which the manually actuatable element operates to lock, unlock and release the latch mechanism, the drive path including a spring that acts in a resilient manner when the manually actuatable element is actuated to release the latch mechanism, and when the stepper motor moves the lock lever to the superlocked position.

2. The lock mechanism as defined in claim 1 in which the spring acts as a solid member when the manually actuatable element is actuated to move the lock lever from the unlocked to the locked position and/or from the locked position to the unlocked position.

3. The lock mechanism as defined in claim 1 in which the spring acts in a resilient manner when the manually actuatable element is actuated in an attempt to move the lock lever from the superlocked position.

4. The lock mechanism as defined in claim 1 in which the drive path is connected to the lock lever at a position where a turning moment applied to the lock lever by actuation of the manually actuatable element is greater when the lock lever is moved from the lock position or from the unlocked position than when an attempt is made to move the lock lever from the superlocked position.

5. The lock mechanism as defined in claim 1 in which a line of action of that pan of the drive path connected to the lock lever is substantially in line with an axis of the lock lever when the manually actuatable element is actuated in an attempt to move the lock lever from the superlocked position.

6. The lock mechanism as defined in claim 1 in which the drive path includes a release lever pivotally mounted about a pivot axis, the pivot axis being fixed relative to the latch mechanism.

7. The lock mechanism as defined in claim 1 including a lock lever stop operable to limit rotation of the lock lever.

8. The lock mechanism as defined in claims 1 including a drive path stop operable to limit movement of at least a part of the drive path.

9. The lock mechanism as defined in claim 1 in which the lock lever is in the form of a lock gear having an array of gear teeth.

10. The lock mechanism as defined in claim 1 in which the lock lever is rotatably mounted to move between the unlocked, locked, and superlocked positions.

11. A lock mechanism including a lock lever movable between unlocked, locked and superlocked positions, the lock lever being connected to further components of the lock mechanism to provide for corresponding unlocked, locked and superlocked conditions of the lock mechanism, the lock lever being operably movable between the unlocked, locked and superlocked positions by a stepper motor and through a drive path by a manually actuatable element, the drive path including a spring, and with a line of action substantially in line with an axis of the lock lever when the manually actuatable element is actuated in an attempt to move the lock lever from the superlocked position, the spring acting in a resilient manner when the stepper motor moves the lock lever to the superlocked position, and when an attempt is made to move the lock lever from the superlocked position.

12. A lock mechanism including a lock lever movable between unlocked, locked and superlocked positions, the lock lever being connected to further components of the lock mechanism to provide for corresponding unlocked, locked and superlocked conditions of the lock mechanism, the lock lever being operably movable between the unlocked, locked and superlocked positions by a stepper motor and through a drive path by a manually actuatable element, wherein the manually actuatable element is a sill button, and wherein the manually actuatable element operates solely to lock and unlock the lock mechanism, the drive path including a spring that acts in a resilient manner when the manually actuatable element is actuated in a attempt to move the lock lever from the superlocked position.

13. The lock mechanism as defined in claim 1 in which the spring changes length when the manually actuatable element is actuated in an attempt to move the lock lever from the superlocked position.

* * * * *

UNITED STATES PATENT AND TRADEMARK OFFICE

CERTIFICATE OF CORRECTION

PATENT NO. : 6,729,663 B2
DATED : May 4, 2004
INVENTOR(S) : Fisher

It is certified that error appears in the above-identified patent and that said Letters Patent is hereby corrected as shown below:

Title page,
Title should read as -- LOCK MECHANISM --

Column 4,
Line 40, “pan” should be -- part --

Signed and Sealed this

Twenty-seventh Day of July, 2004

JON W. DUDAS
*Acting Director of the United States Patent and Trademark Office*